US008704725B2

(12) United States Patent
Xu et al.

(10) Patent No.: US 8,704,725 B2
(45) Date of Patent: Apr. 22, 2014

(54) CAPACITIVE GROUNDED RF COAXIAL CABLE TO AIRSTRIP TRANSITION, AND ANTENNA THEREOF

(75) Inventors: Guolong Xu, Jiangsu (CN); Lu Yu, Jiangsu (CN); Hangsheng Wen, Jiangsu (CN); Michael Francis Bonczyk, McAllen, TX (US)

(73) Assignee: Andrew LLC, Hickory, NC (US)

( * ) Notice: Subject to any disclaimer, the term of this patent is extended or adjusted under 35 U.S.C. 154(b) by 308 days.

(21) Appl. No.: 13/075,713

(22) Filed: Mar. 30, 2011

(65) Prior Publication Data

US 2011/0241965 A1 Oct. 6, 2011

(51) Int. Cl.
*H01P 5/08* (2006.01)

(52) U.S. Cl.
USPC ..... 343/847; 343/702; 343/700 MS; 343/722; 455/41.1

(58) Field of Classification Search
USPC ..... 343/847, 702, 700 MS, 720, 722; 455/41.1
See application file for complete search history.

(56) References Cited

U.S. PATENT DOCUMENTS

| | | | | |
|---|---|---|---|---|
| 5,469,181 | A * | 11/1995 | Yarsunas | 343/815 |
| 5,929,822 | A | 7/1999 | Kumpfbeck et al. | |
| 2004/0183739 | A1 | 9/2004 | Bislules et al. | |
| 2005/0062651 | A1 | 3/2005 | Dai et al. | |
| 2005/0068250 | A1 | 3/2005 | Cornec et al. | |
| 2005/0179610 | A1 | 8/2005 | Le et al. | |
| 2008/0150816 | A1* | 6/2008 | Rahola et al. | 343/720 |
| 2009/0004918 | A1* | 1/2009 | Papanide et al. | 439/620.03 |
| 2009/0191753 | A1 | 7/2009 | Olson et al. | |
| 2010/0188304 | A1* | 7/2010 | Clymer et al. | 343/753 |
| 2010/0231460 | A1* | 9/2010 | Chiang et al. | 343/702 |
| 2011/0050513 | A1* | 3/2011 | Hill et al. | 343/702 |
| 2012/0302088 | A1* | 11/2012 | Van Swearingen et al. | 439/378 |

OTHER PUBLICATIONS

International Preliminary Report on Patentability for related PCT application No. PCT/US2011/030559 dated Oct. 11, 2012.
International Search Report for PCT/US2011/030559 for related PCT application.
Supplementary European Search Report for related EP App. No. EP 11 76 3381 dated Nov. 26, 2013.

* cited by examiner

*Primary Examiner* — Allyson Trail
(74) *Attorney, Agent, or Firm* — Husch Blackwell LLP

(57) ABSTRACT

The present invention provides a capacitive grounded RF coaxial cable to airstrip transition which comprises a conductive ground plane, an insulating gasket, a reflector plate and an insulating fixing component. The conductive ground plane, the insulating gasket and the reflector plate are attached uniformly and tightly in sequence and fixed together by the insulating fixing component. The outer surface of the conductive ground plane is connected conductively with the outer conductor of the RF coaxial cable. Preferably, the conductive ground plane is a metal plate and the insulating gasket is a plastic gasket. The capacitive grounded RF coaxial cable to airstrip transition further comprises at least one perforation penetrating the conductive ground plane, the insulating gasket and the reflector plate in sequence. The insulating fixing component includes at least one insulating rivet and at least one conductive supporting piece is arranged on the outer surface of the conductive ground plane. The present invention further provides an antenna comprising this transition. Therefore the present invention is designed skillfully, simple in structure, simple and convenient to assemble, has a low cost, avoids metals' direct contact to obviate the difficulty of maintaining the constant surface pressure, and realizes the grounding without producing third-order intermodulation, to completely eliminate unstable factors, and therefore is suitable for large-scale popularization.

30 Claims, 8 Drawing Sheets

CAPACITIVE GROUNDED RF COAXIAL CABLE TO AIRSTRIP TRANSITION, AND ANTENNA THEREOF

CROSS-REFERENCE TO RELATED APPLICATIONS

This application claims the benefit of the filing date of Chinese Patent Application No. 201010156429.1 filed Mar. 31, 2010.

FIELD OF TECHNOLOGY

The present invention relates to the field of RF signal transmission, in particular to a capacitive grounded RF coaxial cable to airstrip transition, for the effective RF connection of an antenna radiating element and a branch feeder of a power division network, and to an antenna comprising this transition.

DESCRIPTION OF RELATED ARTS

The problem of signal interference has existed in the process of the high-frequency signal transmission from an RF coaxial cable to an airstrip, in which the very advanced problem of signal interference is the "third-order intermodulation" problem (i.e. the PIM problem).

Third-order intermodulation means a spurious signal is produced after the beat (frequency mixing) generated with the second harmonic of one signal and the fundamental wave of the other signal due to the presence of non-linearity factor when two signals are present in a linear system. For example, the second harmonic of F1 is 2F1, which generates a spurious signal 2F1-F2 with F2. Since one signal is a second harmonic (a second-order signal), and the other signal is a fundamental signal (a first-order signal), they are combined to be a third-order signal, wherein 2F1-F2 is known as the third-order intermodulation signal that is generated in the modulation process. Also, because the beat signal is generated by the mutual modulation of these two signals, the newly generated signal is called the third-order intermodulation distortion signal. The process of generating this signal is called third-order intermodulation distortion. Similarly, a spurious signal 2F2-F1 is also produced with F2 and F1, as the frequencies of the signals 2F1-F2 and 2F2-F1 lie generally very close to those of the original signals F2 and F1, so as to result in 2F1-F2 and 2F2-F1 within the receiving band of the present system, to interfere with the receiving system, to affect the system capacity of the receiving terminal. This is the third-order intermodulation interference.

The problem existing in most existing technologies, for a very long period of time, is to adopt the way of grounding the RF coaxial cable outer conductor directly by soldering the RF coaxial cable outer conductor to a metal sheet and then fixing the metal sheet on a reflector plate directly with screws and nuts, so a direct contact between metals will be produced inevitably. All concerns are focused on how to make this direct contact have a relatively constant contact pressure so as to reduce the effect of the third-order intermodulation. In the long-term experiments (including setting a consistent torque to lock screws and nuts, selecting suitable contacting area, improving the smooth degree of the contacting area or using different fasteners and glues, etc.), the results showed that the connections by any fasteners not absolutely stable, the deformations of the metals themselves, changes of temperature and humidity can cause pressure changes, so as to produce the effect of the third-order intermodulation to the antenna sooner or later, further to affect the performance of the antenna.

Moreover, the existing design for RF coaxial cable grounding is to use RF coaxial cable interface and fasteners (PEM studs, washers and nuts) to connect the RF coaxial cable outer conductor directly to the reflector plate, but this configuration is complicated and time-costly and the loosed fasteners will cause PIM (passive intermodulation) problem.

The Chinese patent application CN98814323 disclosed a patch antenna comprising a conductive ground plate, a conductive patch arranged in parallel above said conductive ground plate, a feed conductor for feeding said patch antenna, and a dielectric substrate material arranged between the conductive ground plate and the conductive patch, wherein the feed conductor is connected to one side of the dielectric substrate material and the conductive patch is connected to another side of said electric substrate material. The dielectric material provided between the patch and the ground plate serves as increasing cross-polarization separation and matching the antenna impedance. Thus, cross-polar separation and increased bandwidth can be achieved within the patch antenna in a simple and cost-effective way. Moreover, an ordinary probe feed and coaxial cables can be used and precise small capacitance can be implemented.

The Chinese patent application CN200780005856.6 disclosed a small-size wide-band antenna which includes a radiation element formed on a dielectric substrate and a coaxial cable as power supply means for supplying double-pole potential to the radiation element. The radiation element includes a ground potential unit to which ground potential is supplied via an external conductor of the coaxial cable and an opposite-pole potential unit to which a potential forming a pair with the ground potential is supplied via a center conductor of the coaxial cable. The ground potential unit includes a pair of conductors formed in a tapered shape on the front and the rear surface of the dielectric substrate and is mutually capacity-coupled. The opposite-pole potential unit includes a pair of conductors formed in a tapered shape on the front and the rear surface of the dielectric substrate and is mutually capacity-coupled. Each of the ground potential unit and the opposite-pole potential unit has a power supply point at a tapered apex of each conductor. The small-size wide-band antenna further includes a stub conductor as an impedance matching unit for matching the impedance between the radiation element and the power supply means.

The US publication US20080218417 and the U.S. Pat. No. 7,541,982 both disclosed a microstrip antenna, and that microstrip antenna employs a metallic patch which is positioned on the top surface of a dielectric substrate. The dielectric substrate has the bottom surface coated with a suitable metal to form a ground plane. A hole is formed through the ground plane, through the dielectric to allow access to the bottom surface of the patch. A center conductor of a coaxial cable is directly connected to the patch. The center conductor of the coaxial cable is surrounded by a metallic housing within the substrate area. The patch forms a first plate for the capacitance while the diameter of the outer housing of the coaxial cable within the substrate is increased to form another plate on the end of the coaxial cable. The value of capacitance can be adjusted by the area of the metallic housing relative to the dielectric constant of the spacing material, and the spacing between the plates. The sum of the probe inductive impedance and microstrip patch antenna input impedance using the direct probe connection is adjusted and centered at a desired design center frequency and many such frequencies can be accommodated.

The U.S. Pat. No. 6,307,508 disclosed a flat antenna with a simplified feeder point. The flat antenna consists of a round patch antenna section, a dielectric material, and a grounded conductive plate. The patch antenna section is arranged so as to confront the grounded conductive plate via the dielectric material. The center conductor of a coaxial cable is inserted into the opening formed in the grounded conductive plate and further penetrates the dielectric material of a thickness of t. The center conductor is electrically connected with the feeder point P of the patch antenna section. The outer conductor of the coaxial cable is connected to the grounded conductive plate. The center conductor has the inductive impedance L added by the penetration length of the dielectric material. Improved matching characteristics can be provided by setting the resonance frequency of the patch antenna section to a higher frequency than received frequencies and by adding a capacitive impedance to the impedance of the feeder point.

The U.S. Pat. No. 6,421,030 disclosed a system and method for mounting a slightly longer than ¼ wavelength whip antenna to a ground plane with an integrated electrical impedance match which use a brass disk, threaded to the bottom portion of the whip and which is isolated for ground plane by a Delrin® acetal resin spacer, to provide a shunt capacitance.

However, the coupling structures in all above-mentioned references are of coupling the transmission line to the antenna radiator directly through a coupling structure to achieve the maximum of the radiated power on the premise of impedance matching, and all above-mentioned references have impedance matching graphs, which obviously are used to solve the antenna impedance matching problem that is the basic problem existing in the antenna structure. According to the principles of the antenna, only the matching impedance can make the maximum of the radiation output power of the antenna radiation end; wherein by adding adjustable capacitors in inductive circuit, the manner of the coupling capacitor is utilized, so as to achieve the impedance matching. However the signal interference problem is not mentioned in these references at all.

SUMMARY OF THE INVENTION

Aspects of the present invention generally pertain to a capacitive grounded RF coaxial cable to airstrip transition and an antenna thereof. The capacitive grounded RF coaxial cable to airstrip transition is designed skillfully, simple in structure, simple and convenient to assemble, has a low cost, avoids metals' direct contact to obviate the difficulty of maintaining the constant surface pressure, realizes the RF grounding without producing third-order intermodulation, to completely eliminate unstable factors, and therefore is suitable for large-scale popularization.

In order to realize the above aims, in a first aspect of the present invention, a capacitive grounded RF coaxial cable to airstrip transition is provided and comprises a conductive ground plane, an insulating gasket, a reflector plate and an insulating fixing component. The conductive ground plane, the insulating gasket and the reflector plate are attached uniformly and tightly in sequence and fixed together by the insulating fixing component. The outer surface of the conductive ground plane is connected conductively with the outer conductor of the RF coaxial cable.

In a further aspect, the conductive ground plane is a metal plate.

In yet another aspect, the metal plate is a tin-plated copper plate.

In a further aspect, the capacitive grounded RF coaxial cable to airstrip transition further comprises at least one perforation. The perforation penetrates the conductive ground plane, the insulating gasket and the reflector plate in sequence.

In a further aspect, the thickness d of the insulating gasket meets the following relationship:

$$\frac{d}{2\pi f \varepsilon_r \varepsilon_0 A} \leq 1,$$

wherein, A is the coupling area of the conductive ground plane and the reflector plate, f is the working frequency of the capacitor formed by the conductive ground plane, the insulating gasket and the reflector plate, $\in_r$ is the relative dielectric constant of the insulating gasket, $\in_0$ is the absolute dielectric constant.

In yet another aspect, the thickness d of the insulating gasket is 0.01~2 mm.

In yet another aspect, the thickness of the insulating gasket d=0.05 mm, $\in_s$=3.2, $\in_0$=8.851×10$^{-12}$ F/m, f=1710 MHz, then A≥160 mm$^2$.

In a further aspect, the insulating gasket is a plastic gasket.

In yet another aspect, the plastic gasket is a polyester gasket.

In a further aspect, the insulating fixing component includes at least one insulating rivet, which penetrates the conductive ground plane, the insulating gasket and the reflector plate in sequence so as to fix the conductive ground plane, the insulating gasket and the reflector plate by attaching the conductive ground plane, the insulating gasket and the reflector plate uniformly and tightly in sequence.

In yet another aspect, the insulating rivet is a plastic rivet.

In yet another aspect, the plastic rivet is a nylon rivet.

In yet another aspect, the insulating rivet comprises a first riveting piece and a second riveting piece butted mutually, the first riveting piece and the second riveting piece are butted mutually and fixed by binding with a binding material.

In a further aspect, at least one conductive supporting piece is arranged on the outer surface of the conductive ground plane, and supports the outer conductor, so that the outer surface of the conductive ground plane is connected conductively with the outer conductor through the conductive supporting piece, for example by tin soldering.

In a further aspect, the capacitive grounded RF coaxial cable to airstrip transition further comprises an airstrip which has a connecting hole for connecting with and penetrating the center conductor.

In a second aspect of the present invention, a capacitive grounded RF coaxial cable to airstrip transition is provided and comprises a conductive ground plane; an insulating gasket, a reflector plate and an insulating fixing component. The outer surface of the conductive ground plane is connected conductively with the outer conductor of the RF coaxial cable. The insulating fixing component includes at least one insulating rivet, which penetrates the conductive ground plane, the insulating gasket and the reflector plate in sequence so as to fix the conductive ground plane, the insulating gasket and the reflector plate by attaching the conductive ground plane, the insulating gasket and the reflector plate uniformly and tightly in sequence. The thickness d of the insulating gasket meets the following relationship:

$$\frac{d}{2\pi f \varepsilon_r \varepsilon_0 A} \leq 1,$$

wherein, A is the coupling area of the conductive ground plane and the reflector plate, f is the working frequency of the capacitor formed by the conductive ground plane, the insulating gasket and the reflector plate, $\in_r$ is the relative dielectric constant of the insulating gasket, $\in_0$ is the absolute dielectric constant.

In a further aspect, the conductive ground plane is a metal plate.

In yet another aspect, the metal plate is a tin-plated copper plate.

In a further aspect, the capacitive grounded RF coaxial cable to airstrip transition further comprises at least one perforation, the perforation penetrates the conductive ground plane, the insulating gasket and the reflector plate in sequence.

In a further aspect, the thickness d of the insulating gasket is 0.01~2 mm.

In a further aspect, the thickness of the insulating gasket d=0.05 mm, $\in_r$=3.2, $\in_0$=8.851×10$^{-12}$ F/m, f=1710 MHz, then 160 mm$^2$.

In a further aspect, the insulating gasket is a plastic gasket.

In yet another aspect, the plastic gasket is a polyester gasket.

In a further aspect, the insulating rivet is a plastic rivet.

In yet another aspect, the plastic rivet is a nylon rivet.

In a further aspect, the insulating rivet comprises a first riveting piece and a second riveting piece butted mutually, the first riveting piece and the second riveting piece are butted mutually and fixed by binding with a binding material.

In a further aspect, at least one conductive supporting piece is arranged on the outer surface of the conductive ground plane, and supports the outer conductor, so that the outer surface of the conductive ground plane is connected conductively with the outer conductor through the conductive supporting piece, for example by tin soldering.

In a further aspect, the capacitive grounded RF coaxial cable to airstrip transition further comprises an airstrip which has a connecting hole for connecting with and penetrating the center conductor.

In a third aspect of the present invention, an antenna is provided and comprises a capacitive grounded RF coaxial cable, an airstrip, a conductive ground plane, an insulating gasket, a reflector plate and an insulating fixing component. The conductive ground plane, the insulating gasket and the reflector plate are attached uniformly and tightly in sequence and fixed together by the insulating fixing component. The outer surface of the conductive ground plane is connected conductively with an outer conductor of the RF coaxial cable, and the airstrip is connected conductively with a center conductor of the capacitive grounded RF.

The beneficial effects of the present invention are as follows:

1. The capacitive grounded RF coaxial cable to airstrip transition of the present invention couples the conductive ground plane connected with the outer conductor of the RF coaxial cable to the reflector plate with the insulating gasket, thus the conductive ground plane, the insulating gasket and the reflector plate make a capacitive grounding mode, so the present invention is designed skillfully and simple in structure, avoids metals' direct contact to obviate the difficulty of maintaining the constant surface pressure, realizes the grounding without producing third-order intermodulation, to completely eliminate unstable factors, and therefore is suitable for large-scale popularization.

2. The conductive ground plane, the insulating gasket and the reflector plate of the capacitive grounded RF coaxial cable to airstrip transition of the present invention are fixed together by the insulating fixing component such as the insulating rivet(s), and not all fasteners used in the prior art are needed, so the present invention is easy to assemble and space saving which will avoid much interference mechanically. More than 18% in cost for each radiation oscillator will be saved in addition to saved labor time. Therefore the present invention is suitable for large-scale popularization.

3. The capacitive grounded RF coaxial cable to airstrip transition of the present invention can be widely used in airstrip to airstrip, RF coaxial cable to airstrip, airstrip to PCB transitions and dipole grounding in various product families, and is suitable for large-scale popularization.

4. The capacitive grounded cable to airstrip transition of the present invention can be suitable for assembling not only monopolar antenna, but also dipolar antenna, and even multipolar antenna, only requiring making simple changes to the structure. The structure which can be assembled with a dipolar or multipolar antenna is a better structure, because its structure is more compact and more integrated.

DETAILED DESCRIPTION OF THE PREFERRED EMBODIMENT

In order to understand the technical content of the present invention clearly, the present invention is further exemplified by reference to the following examples.

Figure 1:
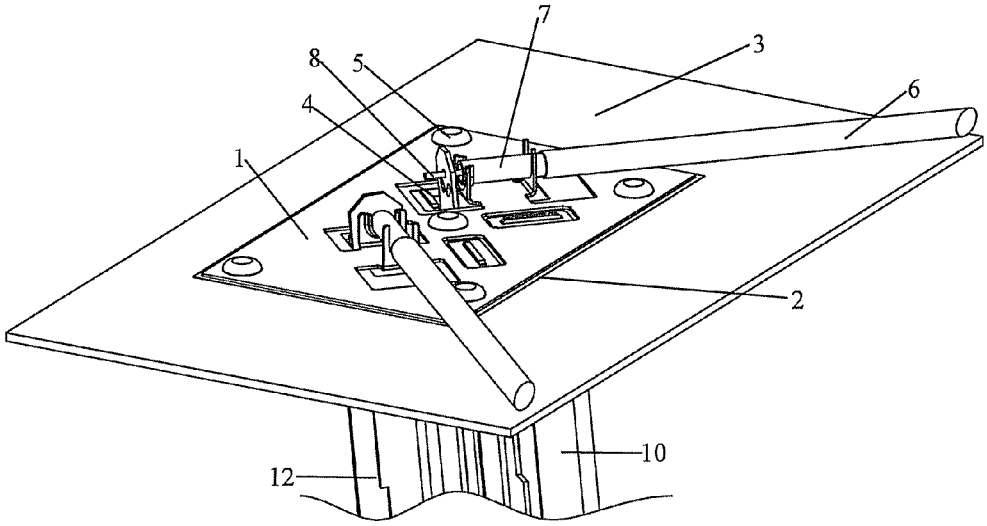
FIG. 1 is a schematic view of the partial three-dimensional structure of one embodiment of the capacitive grounded RF coaxial cable to airstrip transition of the present invention.
Figure 2:
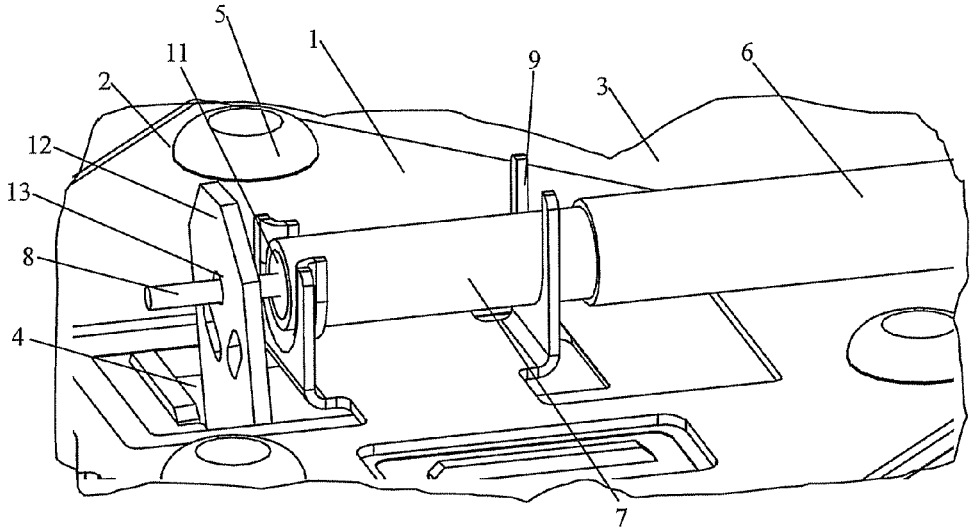
FIG. 2 is a partial enlarged schematic view of the embodiment shown in FIG. 1.
Figure 3:
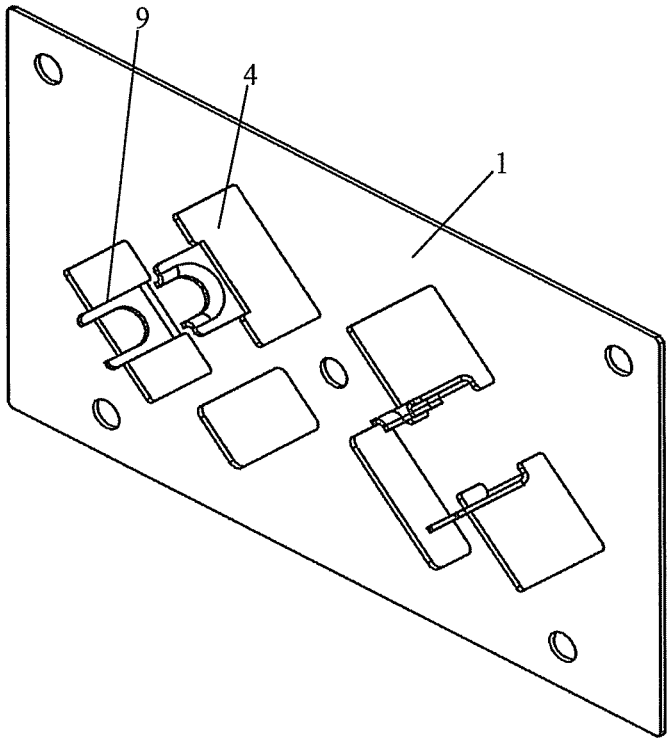
FIG. 3 is a schematic view of the three-dimensional structure of the conductive ground plane of the embodiment shown in FIG. 1.
Figure 4:
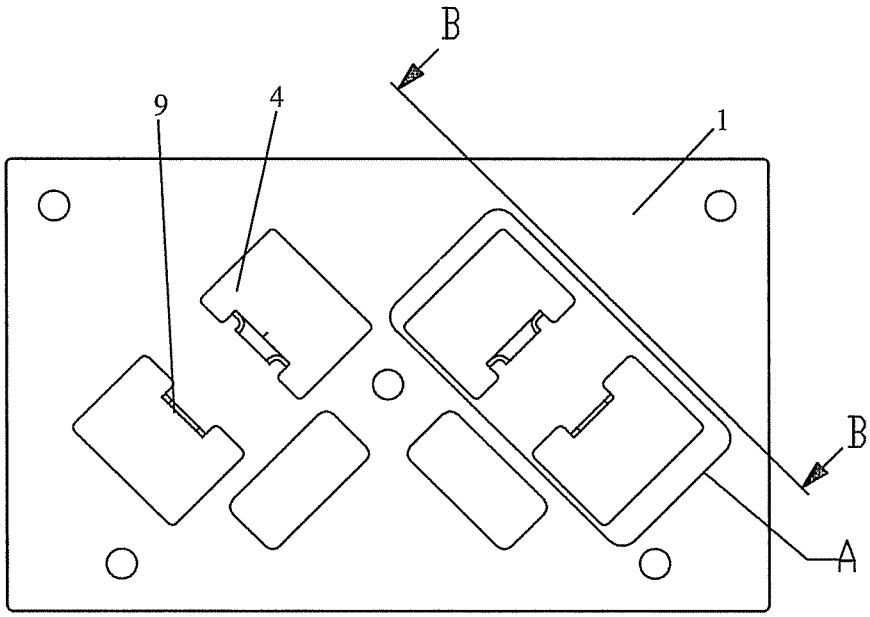
FIG. 4 is a schematic plan view of the conductive ground plane shown in FIG. 3.
Figure 5:
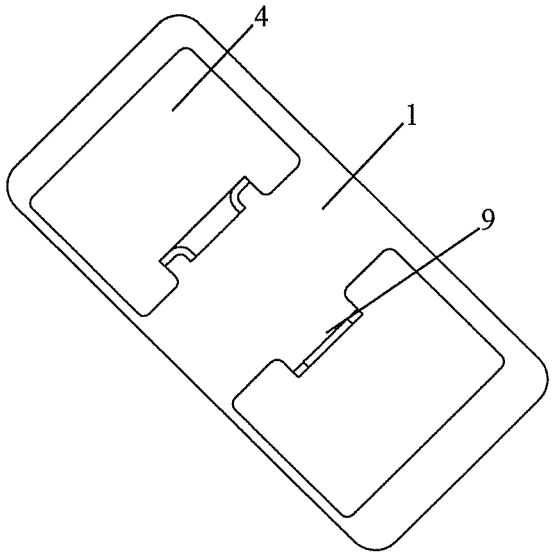
FIG. 5 is an enlarged schematic view of Region A in FIG. 4.
Figure 6:
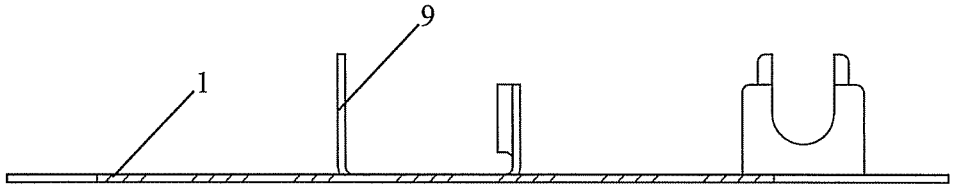
FIG. 6 is a schematic cutaway view along the B-B direction of the conductive ground plane shown in FIG. 4.
Figure 7:
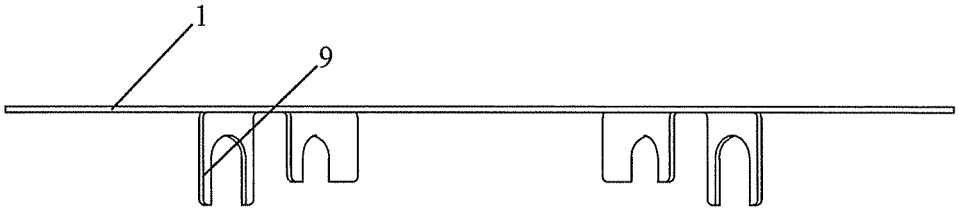
FIG. 7 is a schematic front view of the conductive ground plane shown in FIG. 3.
Figure 8:
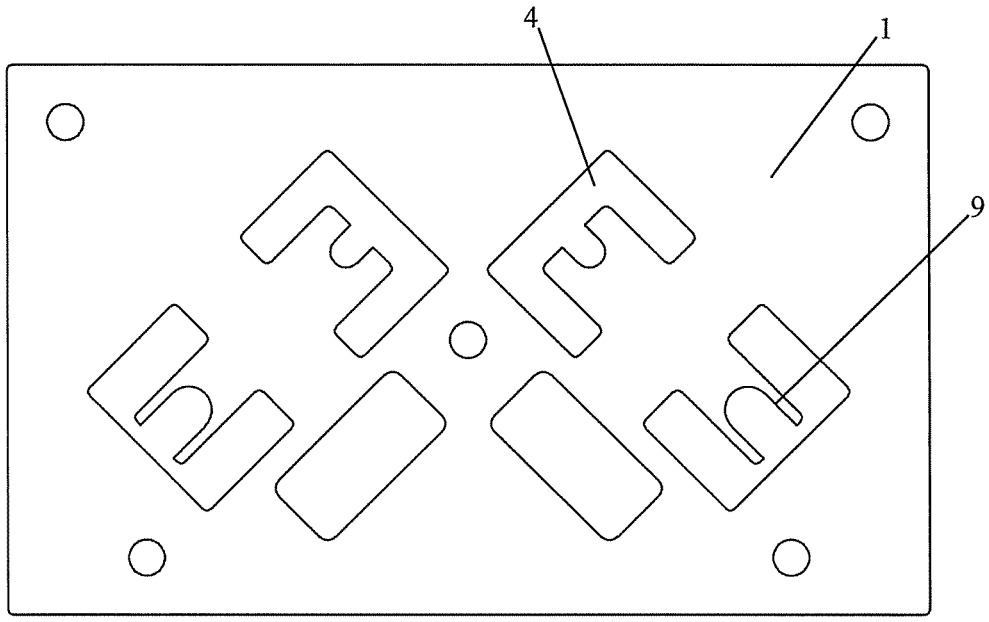
FIG. 8 is a schematic plan view of the conductive ground plane shown in FIG. 3 with the conductive supporting piece unturned up.

Please refer to FIG. 1-2. FIG. 1-2 show one embodiment of the capacitive grounded RF coaxial cable to airstrip transition of the present invention for assembling a dipole antenna. The transition comprises a conductive ground plane 1, an insulating gasket 2, a reflector plate 3 and an insulating fixing component 5. The conductive ground plane 1, the insulating gasket 2 and the reflector plate 3 are attached uniformly and tightly in sequence and fixed together by the insulating fixing component 5. The outer surface of the conductive ground plane 1 is connected conductively with the outer conductor 7 of the RF coaxial cable by tin soldering.

The conductive ground plane 1 is used to achieve the coupling grounding of the outer conductor 7 of the RF coaxial cable, i.e. the outer conductor 7 of the RF coaxial cable is connected with the reflector plate 3 by coupling. And the conductive ground plane 1 can be made of any suitable material; preferably, the conductive ground plane 1 is a metal plate. Please refer to FIG. 3 to FIG. 8, in one embodiment of the present invention, taking the solderability into consideration; the metal plate is a tin-plated copper plate.

Figure 9:
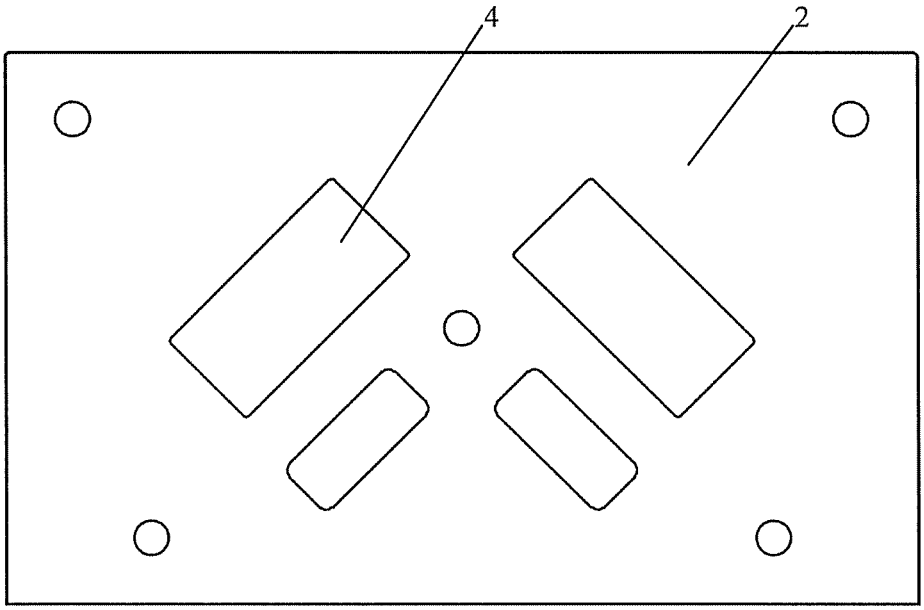
FIG. 9 is a schematic plan view of the insulating gasket of the embodiment shown in FIG. 1.
Figure 10:
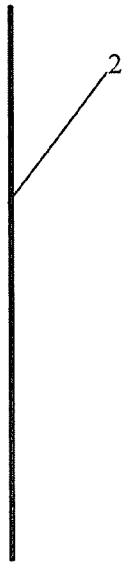
FIG. 10 is a schematic side view of the insulating gasket of the embodiment shown in FIG. 9.

The main role of the insulating gasket 2 is to prevent direct contact between the coupled conductive ground plane 1 and the reflector plate 3 so as to make a coupling structure between the conductive ground plane 1 and the reflector plate 3. This separation is also used to reduce the effect of third-order intermodulation caused by the direct and untight contact between metal parts to the antenna. Preferably, the insulating gasket 2 is a plastic gasket. Please refer to FIG. 9 and FIG. 10, in the embodiment of the present invention, the plastic gasket is a polyester gasket with a thickness of 0.05 mm. As is known in the art, the polyester gasket is currently the thinnest and most economical gasket that can be found on the market, and made of polyester film, and mainly plays the roles of insulation and minimizing the distance between the two coupled things.

The thickness of the insulating gasket 2 should be as thin as possible, thus the coupling efficiency can be increased. But if the thickness should be increased, the grounding can be achieved by expanding the coupling area.

The relationship of the thickness of the insulating gasket 2 and the coupling area is described as follows:

The whole design can be approximately regarded as a capacitor structure, whose electrical resistance is $$X = \frac{1}{2\pi f C},$$

wherein f is the working frequency, and C is the capacitance value. When the C is infinite and X=0, then it is considered to be totally short-circuit. In practical use, when X≤1, a better short-circuit effect can be obtained. As is known to all, the capacitance value $$C = \frac{\varepsilon_r \varepsilon_0 A}{d},$$

wherein $\in_r$ is the relatively dielectric constant of the dielectric, that is, the insulating gasket 2 of this design, $\in_0$ is the absolute dielectric constant, $\in_0 = 8.851\times10^{-12}$ F/m, A is the coupling area, d is the thickness of the insulating gasket 2. Therefore, in order to obtain a better short-circuit effect, the following relationship must be met:

$$\frac{d}{2\pi f \varepsilon_r \varepsilon_0 A} \leq 1.$$

The thickness d of the insulating gasket 2 is preferably 0.01~2 mm. Of course, it can also be outside of the range.

For example: If MYLAR is chosen as the material for the insulating gasket 2 ($£_r$=3.2), the thickness of the insulating gasket 2 d=0.05 mm and the working frequency f=1710 MHz, the coupling area that can enable it to work A≥160 $mm^2$.

The reflector plate 3 is used to reflect the electromagnetic energy emitted from a radiating element of an antenna to form a directional radiation.

The conductive ground plane 1, the insulating gasket 2 and the reflector plate 3 are fixed together by the insulating fixing component 5. Preferably, the insulating fixing component 5 includes at least one insulating rivet, which penetrates the conductive ground plane 1, the insulating gasket 2 and the reflector plate 3 in sequence so as to fix them by attaching them uniformly and tightly in sequence. More preferably, the insulating rivet is a plastic rivet. In the embodiment of the present invention, the plastic rivet is a nylon rivet.

In this structure, in order to make the plastic rivet retain good fastening ability at different temperatures and humidity, at least one glue (all glues with the good property of adhering one plastic with another can be used, for example, Loctite 425 of Henkel company, Germany) is dropped on the plastic rivet, to cause the first riveting piece (not shown) and the second riveting piece (not shown) butted mutually to be further fixed by binding with the glue. This structure has already passed the 10~150 Hz sinusoidal vibration test.

It should be noted that the insulating fixing component 5 is not limited to rivets, all structures that can guarantee not only the insulation but also the close linkage between the conductive ground plane 1 and the reflector plate 3 can be used, for example, the conductive ground plane 1 and the reflector plate 3 can be fixed with a double-sided adhesive, or plastic screws and nuts, etc.

The outer conductor 7 of the RF coaxial cable can be connected with (e.g. by soldering) the outer surface of the conductive ground plane 1 directly. Please refer to FIG. 3-FIG. 8. In the embodiment of the present invention, two conductive supporting pieces 9 are arranged on the outer surface of the conductive ground plane 1, and support the outer conductor 7, so that the outer surface of the conductive ground plane 1 is connected with the outer conductor 7 through the conductive supporting pieces 9. The conductive supporting pieces 9 can be conductive supporting frames or any other suitable structures. The conductive supporting pieces 9 can be made in the conductive ground plane 1 and then turned up. Please refer to FIG. 8, in which the conductive supporting pieces 9 are in the unturned up state.

Figure 14:
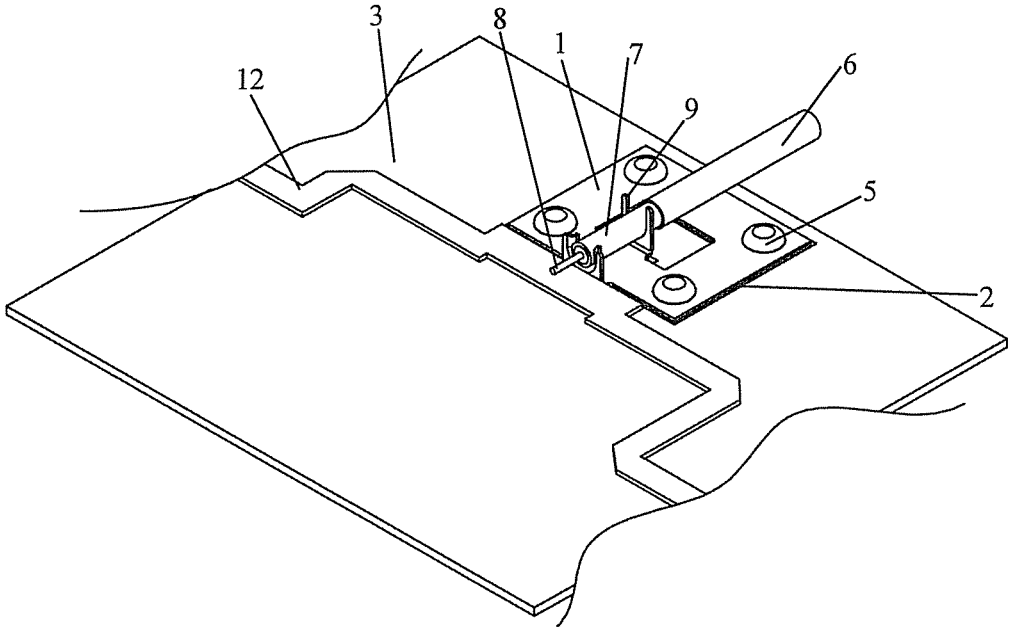
FIG. 14 is a schematic view of the partial three-dimensional structure of another embodiment of the capacitive grounded RF coaxial cable to airstrip transition of the present invention.

The center conductor 8 of the RF coaxial cable can be connected with the airstrip 12 on the same side, and also can be connected with the side airstrip 12 (as shown in FIG. 14). Preferably, the capacitive grounded RF coaxial cable to airstrip transition further comprises at least one perforation 4. The perforation 4 penetrates the conductive ground plane 1, the insulating gasket 2 and the reflector plate 3 in sequence. Through the perforation 4, the center conductor 8 of the RF coaxial cable can be connected with the airstrip 12 at two sides. Please refer to FIG. 1, FIG. 2 and FIG. 11. In the embodiment of the present invention, there are two perforations 4, through which two RF coaxial cables can be connected with the airstrips 12, and the airstrip 12 has a connecting hole for connecting with and penetrating the center conductor.

Figure 11:
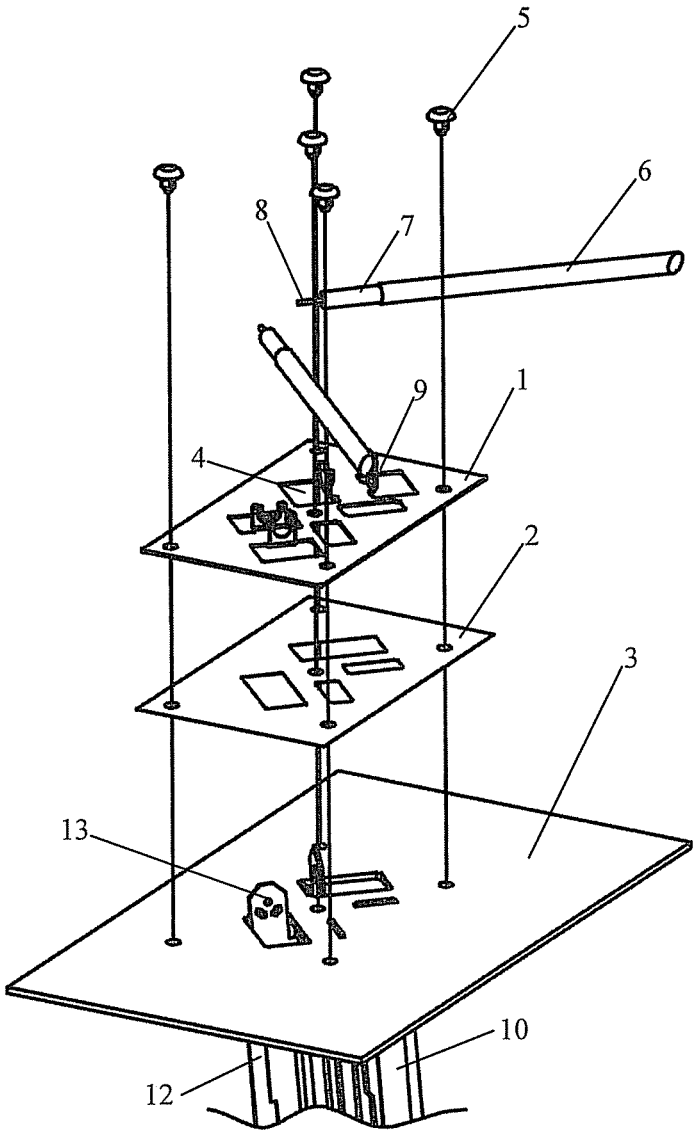
FIG. 11 is a schematic view of the assembling of the embodiment shown in FIG. 1.

Please refer to FIG. 11. When the present invention is assembled, the conductive ground plane 1, the insulating gasket 2 and the reflector plate 3 are fixed with the insulating rivets on which glue can be dropped to enhance the fixation effect. Therefore the conductive ground plane 1 is coupled to the reflector plate 3 with the insulating gasket 2, and the conductive ground plane 1, the insulating gasket 2 and the reflector plate 3 make a capacitive grounding mode. The insulating gasket 2 isolates the conductive ground plane 1 and the reflector plate 3, passes AC and blocks DC.

Please refer to FIG. 11 again. When the present invention is used, the shielding layer 6 is stripped from the RF coaxial cable to expose the outer conductor 7, then the outer conductor 7 is supported on the supporting pieces 9 of the conductive ground plane 1, and can be further welded. The dielectric shielding layer 11 is positioned between the outer conductor 7 and the center conductor 8, and the center conductor 8 of the RF coaxial cable penetrates and is connected with the connecting hole 13 of the airstrip 12 which is connected with the radiation oscillator 10.

Figure 12:
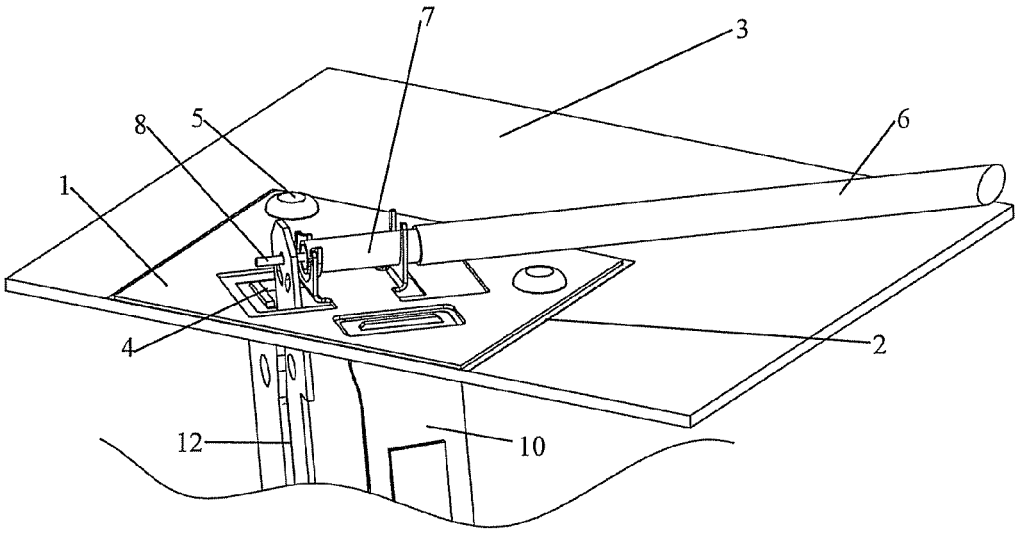
FIG. 12 is a schematic view of the partial three-dimensional structure of another embodiment of the capacitive grounded RF coaxial cable to airstrip transition of the present invention.
Figure 13:
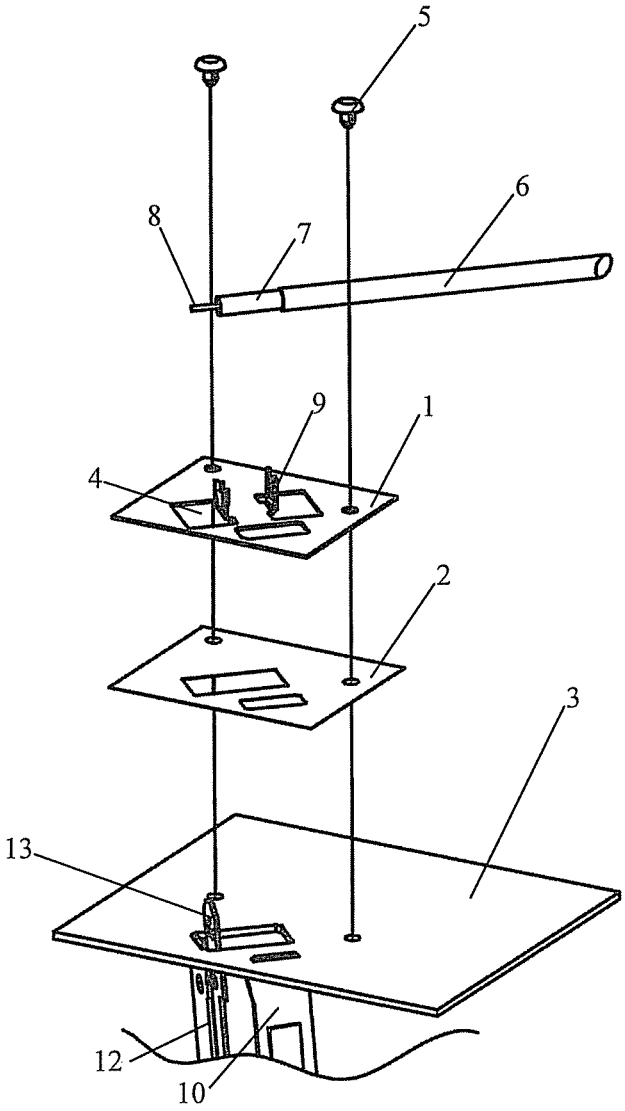
FIG. 13 is a schematic view of the assembling of the embodiment shown in FIG. 12.

Please refer to FIG. 12-13. FIG. 12-13 show another embodiment of the capacitive grounded RF coaxial cable to airstrip transition of the present invention, wherein the same components adopt the same reference numerals, compared with the embodiment shown in FIG. 1-2, the embodiment shown in FIG. 12-13 is to be used for assembling a monopole antenna.

Please refer to FIG. 14. FIG. 14 shows another embodiment of the capacitive grounded RF coaxial cable to airstrip transition of the present invention, wherein the same components adopt the same reference numerals. Compared with the embodiment shown in FIG. 1-2, the embodiment shown in FIG. 14 is to be used for assembling a monopole antenna and to adopt the side feeding manner. That is, the center conductor 8 of the RF coaxial cable is connected with the side airstrip 12. Therefore the perforation 4 is not needed. However the embodiments shown in FIG. 1-2 and FIG. 12-13 both adopt the bottom feeding manner, that is, the center conductor 8 of the RF coaxial cable is connected with the bottom airstrip 12 through the perforation 4.

Thus, according to the above description of the present invention, it should be clear that the capacitive grounded RF coaxial cable to airstrip transition of the present invention can be suitable for assembling a monopolar and a dipolar antenna, and even multipolar antenna, by only making simple changes to the structure, and in the above-mentioned embodiments of the present invention, the structure which can be assembled with a dipolar antenna is a better structure, because its structure is more compact and more integrated.

The working principle of the present invention is, that a large enough overlapping area and a small enough distance form an electromagnetic coupling grounding within the working frequency bands, so as to avoid the third-order intermodulation effect generate by direct grounding on antenna.

The fundamental problem the present invention aims to settle is the problem of signal interference existing in the process of the high-frequency signal transmission, in which the very advanced problem of signal interference is the "third-order intermodulation" problem. However, in the prior art, most of the technical solutions to solve the third-order intermodulation problem adopt the way of grounding the outer conductor directly and applying a constant pressure. In such a technical solution, because the pressure applied will become unstable, the interference signal is generated, not only the signal to noise ratio and the channel quality of the signal will be seriously affected, but the following signal noise reduction and the filtering demodulation will be caused to be carried out with difficulty. While the technical solution the present invention adopts is a non-contact capacitive coupling method, i.e. the coaxial cable is coupled to the transmission line—a microstrip line of the antenna itself through a coupling structure, which is essentially a coupling of a transmission line to another transmission line, and wherein the insulating gasket 2 is very thin, so as to obtain the capacitance as large as possible under the condition that the area of the conductive ground plane 1 is as small as possible, to reduce the interference signal more, to reduce the influence to the receiving system.

The present invention simulates RF grounding through electromagnetic coupling, to avoid metals' direct contact, to obviate the difficulty of maintaining the constant surface pressure, and completely eliminate unstable factors.

The design concept of the present invention can be widely used in airstrip to airstrip, RF coaxial cable to airstrip, airstrip to PCB transitions and dipole grounding in various product families.

To sum up, the capacitive grounded RF coaxial cable to airstrip transition of the present invention is designed skillfully, simple in structure, simple and convenient to assemble, has a low cost, avoids metals' direct contact to obviate the difficulty of maintaining the constant surface pressure, and realizes the grounding without producing third-order intermodulation, to completely eliminate unstable factors, therefore is suitable for large-scale popularization.

While the present invention has been particularly shown and described with references to preferred embodiments thereof, it will be understood by those skilled in the art that various changes in form and details may be made therein without departing from the spirit and scope of the invention as defined by the claims. It is clearly understood therefore that the same is by way of illustration and example only and is not to be taken by way of limitation.

We claim:

1. A capacitive grounded RF coaxial cable to airstrip transition, comprising a conductive ground plane, an insulating gasket, a reflector plate and an insulating fixing component, the conductive ground plane, the insulating gasket and the reflector plate being attached uniformly and tightly in sequence and fixed together by the insulating fixing component, the outer surface of the conductive ground plane being connected conductively with an outer conductor of the RF coaxial cable.

2. The capacitive grounded RF coaxial cable to airstrip transition according to claim 1, wherein the conductive ground plane is a metal plate.

3. The capacitive grounded RF coaxial cable to airstrip transition according to claim 2, wherein the metal plate is a tin-plated copper plate.

4. The capacitive grounded RF coaxial cable to airstrip transition according to claim 1, wherein the capacitive grounded RF coaxial cable to airstrip transition further comprises at least one perforation, the perforation penetrates the conductive ground plane, the insulating gasket and the reflector plate in sequence.

5. The capacitive grounded RF coaxial cable to airstrip transition according to claim 1, wherein the thickness d of the insulating gasket meets the following relationship:

$$\frac{d}{2\pi f \varepsilon_r \varepsilon_0 A} \leq 1,$$

wherein, A is the coupling area of the conductive ground plane and the reflector plate, f is the working frequency of the capacitor formed by the conductive ground plane, the insulating gasket and the reflector plate, $\in_r$ is the relative dielectric constant of the insulating gasket, $\in_0$ is the absolute dielectric constant.

6. The capacitive grounded RF coaxial cable to airstrip transition according to claim 5, wherein the thickness d of the insulating gasket is 0.01~2 mm.

7. The capacitive grounded RF coaxial cable to airstrip transition according to claim 5, wherein the thickness of the insulating gasket d=0.05 mm, $\in_r$=3.2, $\in_0$=8.851×10$^{-12}$ F/m, f=1710 MHz, then A≥160 mm$^2$.

8. The capacitive grounded RF coaxial cable to airstrip transition according to claim 1, wherein the insulating gasket is a plastic gasket.

9. The capacitive grounded RF coaxial cable to airstrip transition according to claim 8, wherein the plastic gasket is a polyester gasket.

10. The capacitive grounded RF coaxial cable to airstrip transition according to claim 1, wherein the insulating fixing component includes at least one insulating rivet, which penetrates the conductive ground plane, the insulating gasket and the reflector plate in sequence so as to fix the conductive ground plane, the insulating gasket and the reflector plate by attaching the conductive ground plane, the insulating gasket and the reflector plate uniformly and tightly in sequence.

11. The capacitive grounded RE coaxial cable to airstrip transition according to claim 10, wherein the insulating rivet is a plastic rivet.

12. The capacitive grounded RF coaxial cable to airstrip transition according to claim 11, wherein the plastic rivet is a nylon rivet.

13. The capacitive grounded RF coaxial cable to airstrip transition according to claim 10, wherein the insulating rivet comprises a first riveting piece and a second riveting piece butted mutually, the first riveting piece and the second riveting piece are butted mutually and fixed by binding with a binding material.

14. The capacitive grounded RF coaxial cable to airstrip transition according to claim 1, wherein at least one conductive supporting piece is arranged on the outer surface of the conductive ground plane, and supports the outer conductor, so that the outer surface of the conductive ground plane is connected conductively with the outer conductor through the conductive supporting piece.

15. The capacitive grounded RF coaxial cable to airstrip transition according to claim 1, wherein the capacitive grounded RF coaxial cable to airstrip transition further comprises an airstrip which has a connecting hole for the center conductor to penetrate and be connected with.

16. The capacitive grounded RF coaxial cable to airstrip transition according to claim 1, wherein the insulating gasket prevents direct contact between the conductive ground plane and the reflector plate so as to make a coupling structure between the conductive ground plane and the reflector plate.

17. A capacitive grounded RF coaxial cable to airstrip transition, comprising a conductive ground plane, an insulating gasket, a reflector plate and an insulating fixing component, the outer surface of the conductive ground plane being connected conductively with the outer conductor of the RF coaxial cable, the insulating fixing component including at least one insulating rivet, which penetrates the conductive ground plane, the insulating gasket and the reflector plate in sequence so as to fix the conductive ground plane, the insulating gasket and the reflector plate by attaching the conductive ground plane, the insulating gasket and the reflector plate uniformly and tightly in sequence, the thickness d of the insulating gasket meeting the following relationship:

$$\frac{d}{2\pi f \varepsilon_r \varepsilon_0 A} \leq 1$$

wherein, A is the coupling area of the conductive ground plane and the reflector plate, f is the working frequency of the capacitor formed by the conductive ground plane, the insulating gasket and the reflector plate, $\in_r$ is the relative dielectric constant of the insulating gasket, $\in_0$ is the absolute dielectric constant.

18. The capacitive grounded RF coaxial cable to airstrip transition according to claim 17, wherein the conductive ground plane is a metal plate.

19. The capacitive grounded RF coaxial cable to airstrip transition according to claim 18, wherein the metal plate is a tin-plated copper plate.

20. The capacitive grounded RF coaxial cable to airstrip transition according to claim 17, wherein the capacitive grounded RF coaxial cable to airstrip transition further comprises at least one perforation, the perforation penetrates the conductive ground plane, the insulating gasket and the reflector plate in sequence.

21. The capacitive grounded RF coaxial cable to airstrip transition according to claim 17, wherein the thickness d of the insulating gasket is 0.01~2 mm.

22. The capacitive grounded RF coaxial cable to airstrip transition according to claim 17, wherein the thickness of the insulating gasket d=0.05 mm, $\in_r$=3.2, $\in_0$=8.851×10$^{-12}$ F/m, f=1710 MHz, then A≥mm$^2$.

23. The capacitive grounded RF coaxial cable to airstrip transition according to claim 17, wherein the insulating gasket is a plastic gasket.

24. The capacitive grounded RF coaxial cable to airstrip transition according to claim 23, wherein the plastic gasket is a polyester gasket.

25. The capacitive grounded RF coaxial cable to airstrip transition according to claim 17, wherein the insulating rivet is a plastic rivet.

26. The capacitive grounded RF coaxial cable to airstrip transition according to claim 25, wherein the plastic rivet is a nylon rivet.

27. The capacitive grounded RF coaxial cable to airstrip transition according to claim 17, wherein the insulating rivet comprises a first riveting piece and a second riveting piece butted mutually, the first riveting piece and the second riveting piece are butted mutually and fixed by binding with a binding material.

28. The capacitive grounded RF coaxial cable to airstrip transition according to claim 17, wherein at least one conductive supporting piece is arranged on the outer surface of the conductive ground plane, and supports the outer conductor, so that the outer surface of the conductive ground plane is connected conductively with the outer conductor through the conductive supporting piece.

29. The capacitive grounded RF coaxial cable to airstrip transition according to claim 17, wherein the capacitive grounded RF coaxial cable to airstrip transition further comprises an airstrip which has a connecting hole for the center conductor to penetrate and be connected with.

30. An antenna comprising: a capacitive grounded RF coaxial cable, an airstrip, a conductive ground plane, an insulating gasket, a reflector plate and an insulating fixing component, the conductive ground plane, the insulating gasket and the reflector plate being attached uniformly and tightly in sequence and fixed together by the insulating fixing component, the outer surface of the conductive ground plane being connected conductively with an outer conductor of the RF coaxial cable, the airstrip being connected conductively with a center conductor of the capacitive grounded RF.

* * * * *